US006686551B2

(12) United States Patent
Pasotto

(10) Patent No.: US 6,686,551 B2
(45) Date of Patent: Feb. 3, 2004

(54) SWITCH, IN PARTICULAR BATTERY CUTOUT SWITCH FOR VEHICLES AND THE LIKE

(75) Inventor: Giorgio Pasotto, Legnago (IT)

(73) Assignee: Menber's Spa, Legnago (IT)

( * ) Notice: Subject to any disclaimer, the term of this patent is extended or adjusted under 35 U.S.C. 154(b) by 0 days.

(21) Appl. No.: 10/196,711

(22) Filed: Jul. 15, 2002

(65) Prior Publication Data

US 2003/0057082 A1 Mar. 27, 2003

(30) Foreign Application Priority Data

Sep. 21, 2001 (EP) ..... 01122729

(51) Int. Cl.[7] ..... H01H 13/62
(52) U.S. Cl. ..... 200/566; 200/526
(58) Field of Search ..... 200/566, 560, 200/279, 318.2, 336, 568, 526–529, 564, 570, 571, 574, 323–325, 43.04, 43.08

(56) References Cited

U.S. PATENT DOCUMENTS 1,889,175 A * 11/1932 Evans ..... 200/16 A
2,377,250 A * 5/1945 Lawson ..... 200/538
4,538,036 A 8/1985 Heinrich et al.
5,310,974 A * 5/1994 Churchill et al. ..... 200/566
5,593,022 A * 1/1997 Schaeffer et al. ..... 200/308
5,624,023 A * 4/1997 Chasen et al. ..... 200/526
5,744,873 A 4/1998 Hasegawa et al.
6,444,932 B1 * 9/2002 Resmalm ..... 200/334
6,512,189 B1 * 1/2003 Schuberth et al. ..... 200/334
6,520,267 B2 * 2/2003 Funfer et al. ..... 173/48

FOREIGN PATENT DOCUMENTS

EP 0645791 A 3/1995
EP 0685783 A 12/1995
GB 2046023 A 11/1980

* cited by examiner

*Primary Examiner*—Elvin Enad
*Assistant Examiner*—Lisa Klaus
(74) *Attorney, Agent, or Firm*—TraskBritt

(57) ABSTRACT

A switch destined in particular for usage as a general cutout switch for batteries in low-voltage vehicle electrical systems and the like includes a supporting body carrying at least one pair of fixed electrical contacts,—a mobile element carrying at least one mobile electrical contact, cooperating with the fixed contacts and movable in a rectilinear direction between an open-contacts position and a closed-contacts position and vice versa, a rotary control member suitable for controlling the movement of the mobile element, an elastic structure that tends to push the mobile element towards the open-contacts position, mutually cooperative contact surfaces provided on the control member and on the mobile element and mutually cooperative stop mechanisms provided on the supporting body and on the rotary control member.

9 Claims, 6 Drawing Sheets

SWITCH, IN PARTICULAR BATTERY CUTOUT SWITCH FOR VEHICLES AND THE LIKE

BACKGROUND OF THE INVENTION

1. Field of the Invention

The present invention refers to switch, destined in particular for usage as a general cutout switch for batteries in low-voltage vehicle electrical systems and the like.

2. Statement of the Art

Switches of this type are normally equipped with at least a pair of fixed contacts and at least one mobile contact that can be shifted, with respect to the fixed contacts, between an open position and a closed position.

Switches destined for utilization in vehicle electrical systems as battery cutouts must be capable of guaranteeing circuit interruption in emergency situations via a simple and intuitive manoeuvre, such as simply applying pressure on a knob for example.

In other applications, instead, there can exist the opposite need, i.e. that of only allowing the switch to be opened or closed by personnel in possession of a special key.

BRIEF SUMMARY OF THE INVENTION

The object of present invention is to provide a switch that is simple, robust and reliable, having a control mechanism that allows versions of the switch commanded by both knob and key to be realized.

BRIEF DESCRIPTION OF THE DRAWINGS

The present invention will now be described in detail, with reference to the enclosed drawings, which are supplied as a non limitative example and where.

DETAILED DESCRIPTION OF THE INVENTION

Figure 1:
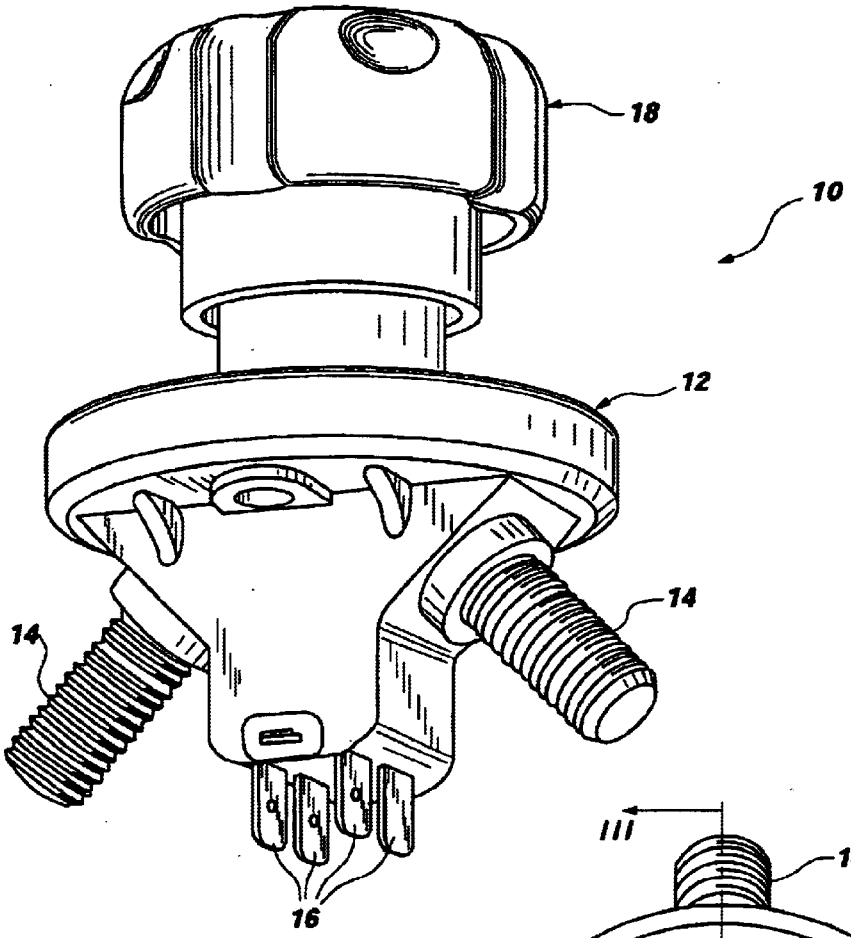
FIG. 1 is a perspective view of a first form of embodiment of a switch in accordance with the invention.

With reference to FIG. 1, item 10 indicates a first form of embodiment of the switch in accordance with the invention, destined for utilization as a battery cutout for vehicles, boats and the like. The switch 10 includes a supporting body 12 in an injection moulded plastic material, from which two main electrical contacts 14 protrude. In the example of embodiment illustrated in the figure, the switch 10 is also equipped with a number of secondary, electrical spade terminals 16. The switch 10 in accordance with the first form of embodiment of the present invention includes a control knob 18 that is used to control the opening and closing manoeuvres of the switch.

Figure 4:
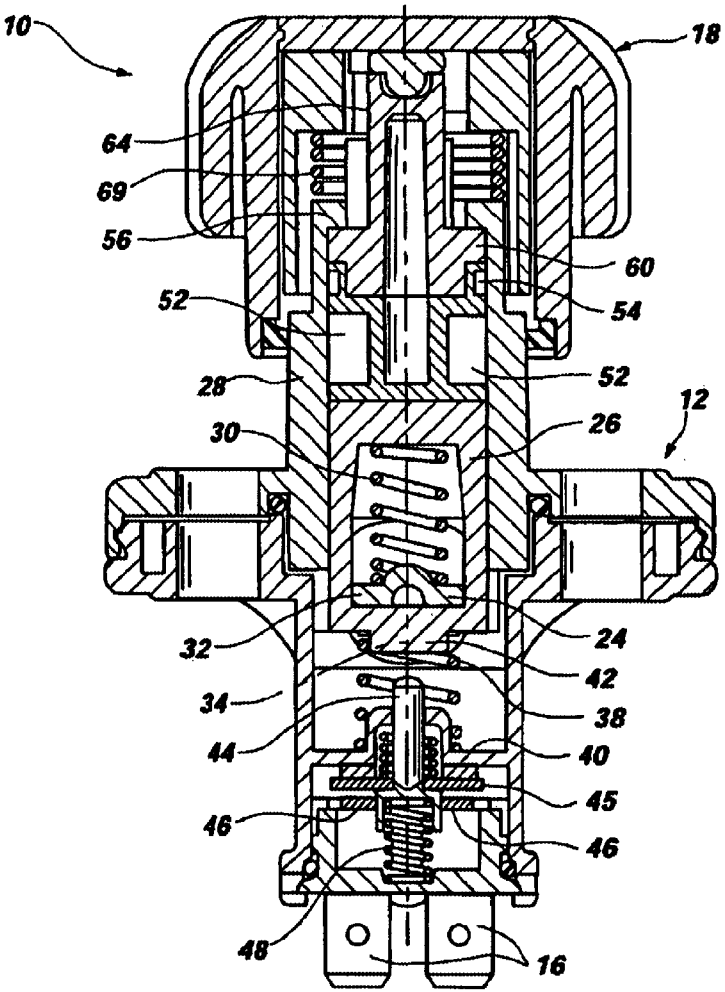
Figure 3:
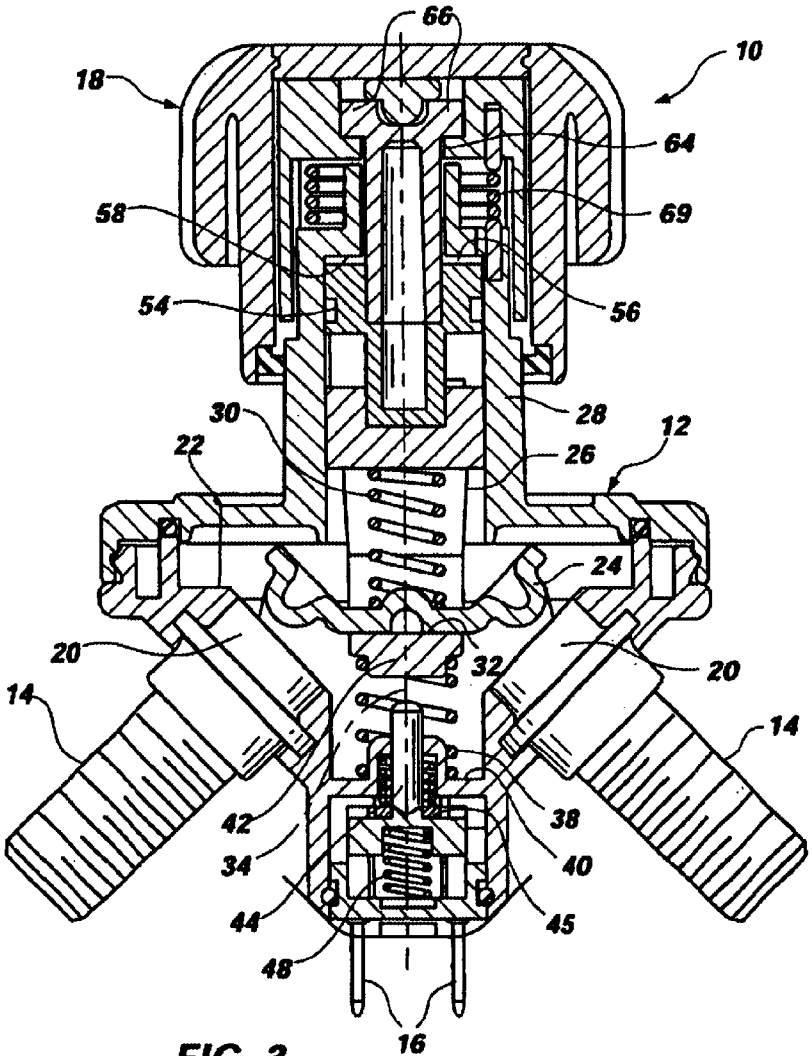

With reference to FIGS. 3 and 4, the terminals 14 carry a pair of fixed contacts 20 situated inside a cavity 22 in the main body 12. The fixed contacts 20 cooperate with a mobile contact 24 carried on a mobile element 26, mounted such that it can slide within a tubular portion 28 of the main body 12. The mobile element 26 carries a coil spring 30 in compression that presses the mobile contact 24 against the seat 32 of the mobile element 26. This mobile element cooperates with a prismatic guide 32, created on the inside of the supporting body 12 (FIG. 5) so that it can move along the longitudinal axis 34, but without being able to rotate around the aforesaid axis. The mobile element 26 carrying the mobile contact 24 can move between the open-contacts position illustrated in FIG. 3 and a closed position in which the mobile contact 24 is pressed against the fixed contacts 20. The mobile element 26 is pushed towards the open position by the elastic force produced by the coil spring in compression 38, coaxial with the longitudinal axis 34 and positioned between a wall 40 of the supporting body 12 and an appendage 42 of the mobile element 26.

A small, sliding shaft 44 is arranged along the longitudinal axis 34 and carries an auxiliary mobile contact 45 that cooperates with the auxiliary fixed contacts 46 connected to the auxiliary terminals 16. The shaft 44 is associated with a spring in compression 48 that tends to push it towards the open-contacts position. The appendage 42 of the mobile element 26 rests against the upper end of the shaft 44 in the closed-contacts position and, in turn, presses the shaft 44 in the auxiliary closed-contacts position.

Figure 5:
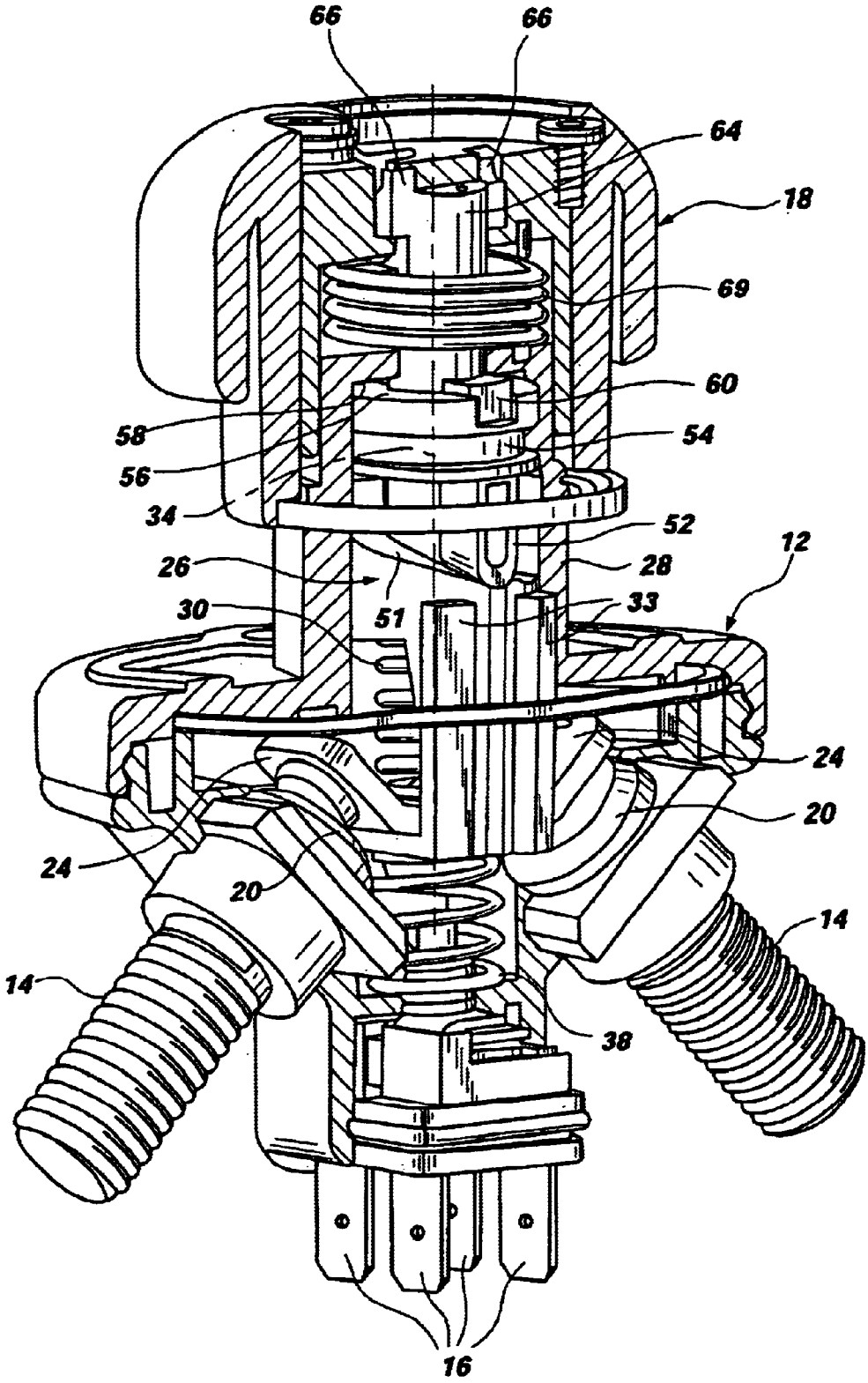
FIG. 5 is a perspective, cutaway view of a the switch in FIG. 1, FIGS. 6 and 7 are partial sectional views illustrating the switch in FIG. 1 in the open position and closed position respectively.
Figure 7:
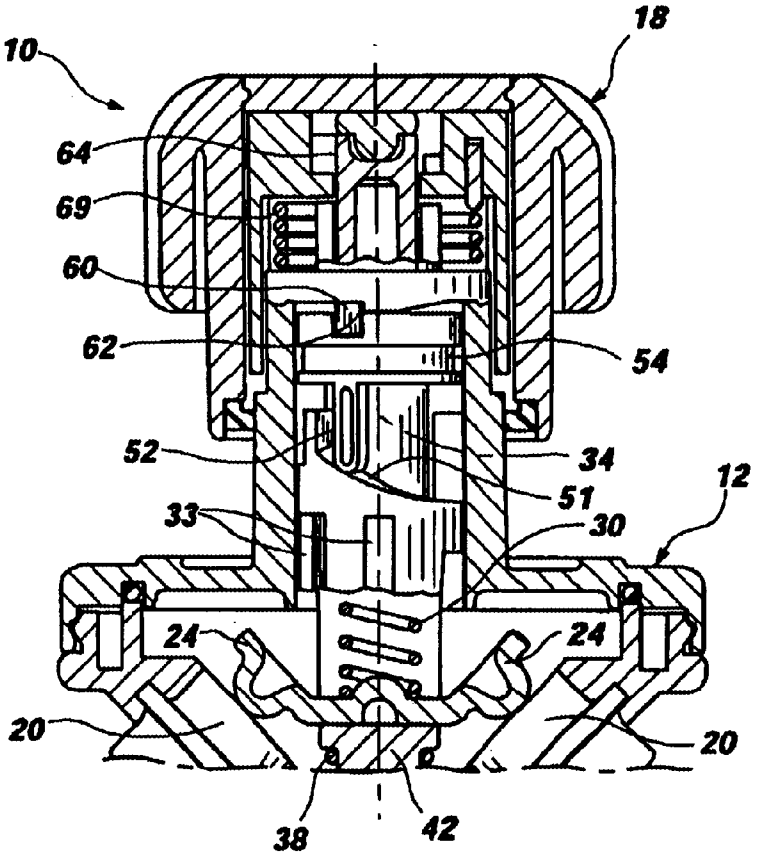

With reference to FIG. 5, at its upper end, the mobile element 26 carries a cam-shaped surface 50, with substantially the form of a wedge obtained from a circular profile. The mobile member 36 is preferably equipped with two or more cam-shaped surfaces 50, angularly equidistant along the upper circumferential border of the mobile element 26. Each of these cam-shaped surfaces 50 cooperates with a presser element 52 carried by a rotary control member 54. The rotary control member 54 is arranged coaxially to and above the mobile element 26 and has an upper surface 56 that faces onto a seat 58 that is fixed with respect to the main body 12 and is preferably obtained as an integral part of the upper end of the tubular portion 28. The rotary control member 54 is pushed against the seat 58 by the elastic force of the spring 38. In fact, the load on the spring 38 pushes the mobile element 26 upward, which in turn, pushes the rotary element 54 upwards via contact between the cam-shaped surfaces 50 and the presser elements 52. The upper surface 56 of the rotary control member 54 is equipped with at least one catch 60 that is destined to cooperate with a corresponding catch 62 present on the contact surface 58 (see FIGS. 6 and 7). As is illustrated in FIG. 7, the reciprocal engagement between the catches 60 and 62 occurs when the angular position of the rotary control member 54 corresponds to the closed-contacts position, i.e. the condition in which the mobile member 26 is in its lowermost position. The rotary control member 54 is also free to move in the direction of the longitudinal axis 34 to disengage the catches 60 and 62, and so allow the switch to return to the open-contacts position. Two or more pairs of cooperating catches 60 and 62 could be provided for on the mutually facing surfaces 56 and 58.

Figure 2:
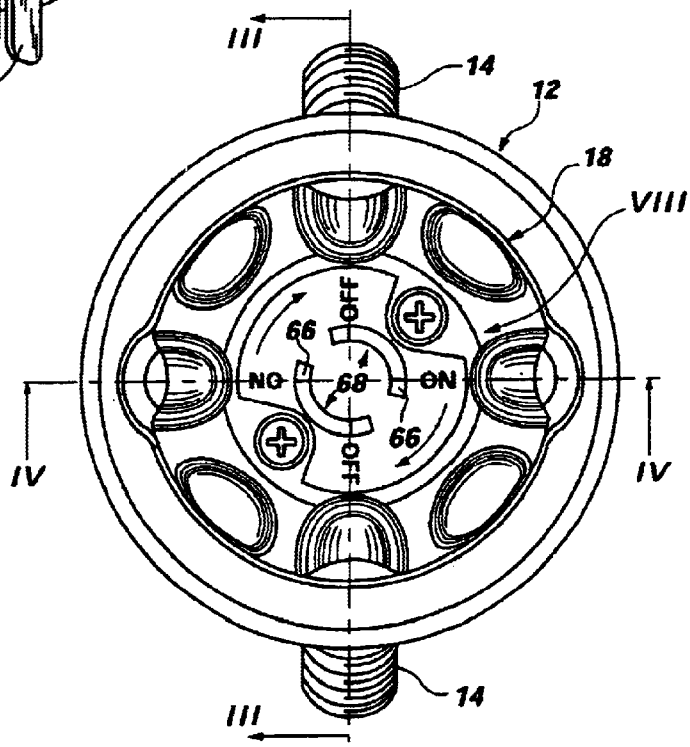
FIG. 2 is a plan view of the switch in FIG. 1, FIGS. 3 and 4 are sectional views along the lines III—III and IV—IV respectively, as shown in FIG. 2.

With reference to FIGS. 2 and 5, the rotary control member 54 has an axial portion 64 that protrudes upwards and is equipped with a pair of appendages 66 that engage with respective arched grooves 68 formed inside the control knob 18 and with their centre on the longitudinal axis 34. A return spring 69 is positioned around the appendage 64 and has its ends anchored to the supporting body 12 and control knob 18 respectively. The grooves 68 have an angular extension of approximately 90°, which corresponds to the angular travel that the control knob 18 must be subjected to in order to bring the switch from the open position to the closed position. The return spring 69 applies an elastic force to the control knob 18 that tends to make it turn in the opposite direction to that in which it must be turned in the manoeuvre to close the switch, or rather the manoeuvre that brings the switch from the open-contacts position to the closed-contacts position. The arched grooves 68 of the control knob 18 appear on the outer surface of the knob, so that the appendages 66 are visible when viewing the switch from above. Preferably, the appendages 66 should be coloured so that they are easily visible and "ON" and "OFF" indicators provided on the top surface of the knob 18 so that the state of the switch, in the respective open-contacts or closed-contacts positions, can be visually determined.

Figure 6:
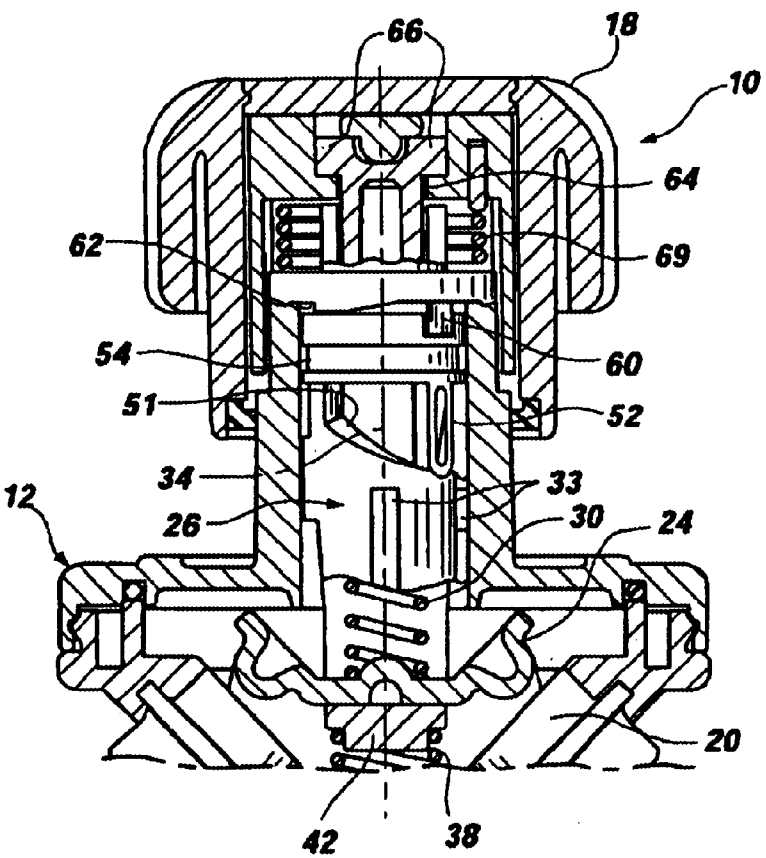
Figure 8:
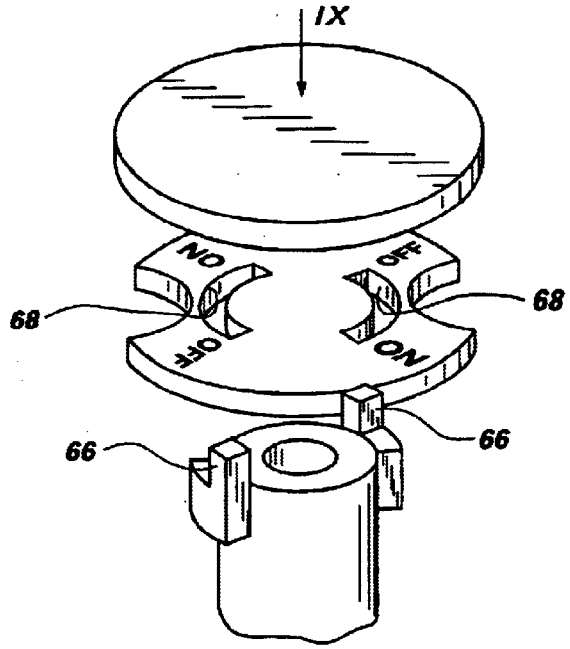
FIG. 8 is a schematic perspective illustrating the part indicated by the arrow VIII in FIG. 2, FIGS. 9, 10, 11 and 12 are schematic plan views perpendicular to the arrow IX in FIG. 8, and FIGS. 13 and 14 are partial, perspective cutaway views of a second form of embodiment of the switch in accordance with the present invention.
Figure 9:
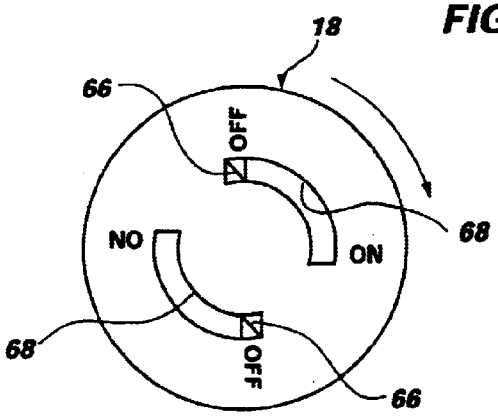
Figure 10:
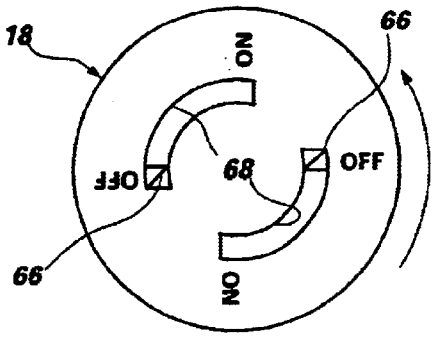
Figure 11:
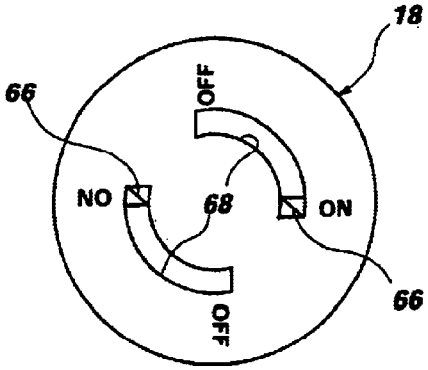

The operation of the switch in accordance with the invention will now be described, starting from the open-contacts configuration illustrated in FIGS. 3 and 6. In this condition, the knob 18 is in the position shown in FIG. 9. The appendages 66 are in contact with the first end of the respective grooves 68. As illustrated in FIG. 6, the position of the presser element of rotary control element 54 is level with the lowest point of the inclined surface 50 and, in consequence, the mobile element 26 is in its upper position, in which the mobile contact 24 is separated from the fixed contacts 20. To set the switch 10 in the closed-contacts operational position, the control knob 18 is turned by approximately 90°, in a clockwise direction with reference to FIG. 9. During this rotation, the appendages 66 are dragged into rotation around the axis 34 by contact with the ends of the grooves 68. In consequence, the axial portion 64 carrying the appendages 66 also performs a rotation of approximately 90° and turns the rotary control member 54 by the same amount. When this rotation is complete, the configuration of the switch is that shown in FIG. 7, where the catch 60 is engaged with the stationary catch 62. The rotation of the rotary control member 54 positions the presser element 52 level with the highest point of the inclined surface 50. Since the mobile element 26 cannot rotate any further with respect to the stationary casing, this element is consequentially obliged to move downwards against the thrust of the spring under compression 38. This downwards motion of the mobile element 26 brings the mobile contact 24 into contact with the fixed contacts 20. The coil spring 30 keeps the mobile contact 24 pressed against the fixed contacts 20 and permits movement of the mobile contact to allow for play and tolerances. When the 90° clockwise rotation of the knob 28 is completed, with respect to the knob, the appendages 66 will be in the position illustrated in FIG. 10. When the user releases the knob 18, it will rotate anticlockwise under the action of the return spring 69. The anticlockwise rotation terminates when the appendages 66 come into contact with the opposite ends of the grooves 68, in the position shown in FIG. 11. This position is a stable position for the knob 18. The appendages 66 are positioned in correspondence to the "ON" sign, which indicates the closed-contacts operational state of the switch 10.

In the closed-contacts position, the rotary control member 54 is kept in a fixed position with respect to the main body 12 by the reciprocal engagement of the teeth 60 and 62. This engagement remains stable due to the fact that the spring 38 exerts an upward, axial thrust that keeps the rotary control member 54 pushed against the surface 58 of the main body 12.

Figure 12:
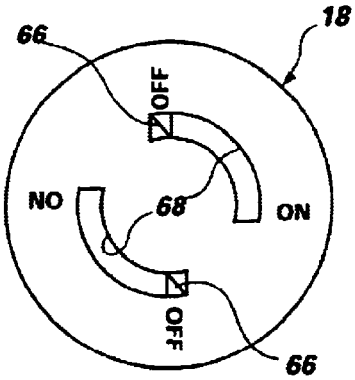

To return the casing to the open-contacts operational position, all that is needed is to push the control knob 18 downwards. This downward force produces a downward movement on the rotary control member 54 that disengages the catch 60 from the corresponding stationary catch 62. As soon as the catch 60 disengages, the rotary control member 54 is free to rotate around the axis 34. Due to the contact between the inclined surface 50 and the presser member 52, the axial thrust of the spring 38 makes the control member 54 rotate and push the mobile element 26 upwards. Rotation of the rotary control member 54 stops when this member reaches an end stop on the stationary casing (not illustrated). During the rotation of the rotary control member 54, the knob 18 remains stationary, thereby obtaining a relative rotation of 900 in the anticlockwise direction between the appendages 66 and the knob 18. The switch thus returns to the configuration illustrated in FIG. 12, where the appendages 66 indicate the "OFF" position, corresponding to the open-contacts position. The fact that the control knob 18 can rotate and is elastically pulled in the opposite direction to that in which it is rotated to close the switch, consequently allows the operational state of the switch to be visibly checked via the appendages 66.

Figure 13:
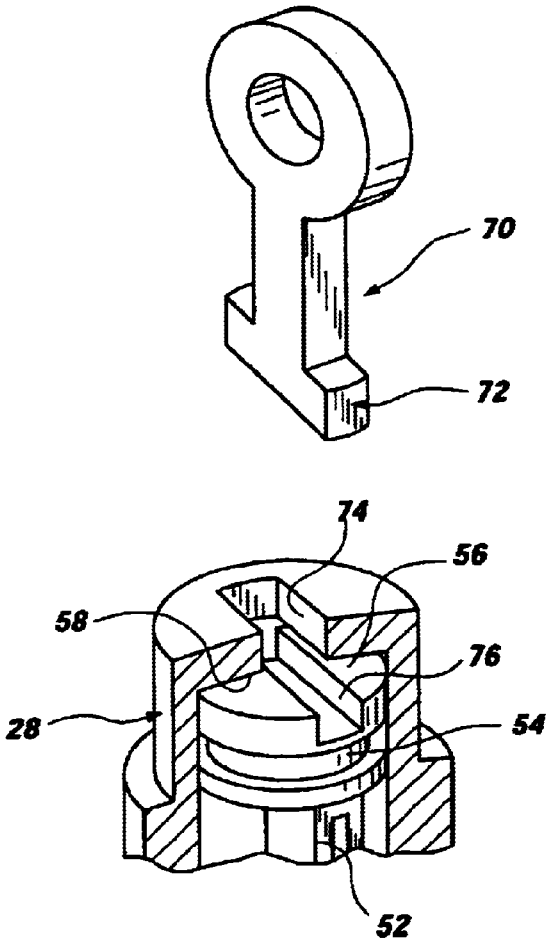
Figure 14:
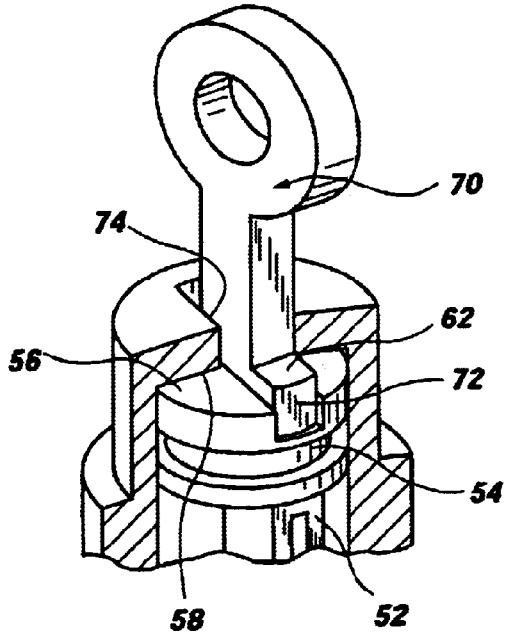

In the device in accordance with the invention, the switch's control mechanism is suitable for realising both a knob-type control and a key-type control. FIGS. 13 and 14 illustrate a variant of the switch in accordance with the invention in which the knob 18 is replaced by a control key 70. The key control 70 has an engagement portion 72 that is inserted via a slot 74 in the tubular portion 28 of the main body 12 and that engages with a seat 76 realised on the upper surface of 56 of the rotary control member 54. Part of the control portion 72 extends beyond the upper surface 56 in order to form the catch 60, as in the previously described solution. In the situation where the switch 10 is open, the seat 76 of the rotary control member 54 is aligned with the slot in the main body and the key can be inserted or removed from the switch. To close the switch, the key 70 must be inserted and turned clockwise until the tooth 60 engages with the corresponding tooth formed on the surface 58 of the main body. In this condition, the switch is closed and the key 70 cannot be extracted. To open the switch, it is sufficient to simply push the key 70 downwards. Following downwards pressure on the key, the rotary control member 54 rotates in the anticlockwise direction, returning to its position that corresponds to the open-contacts position. The operational state of the switch is indicated by the position of the key 70. The switch in this variant of the invention can only be closed by someone possessing the specific key, which could be advantageous from the antitheft viewpoint for example.

The key can only be extracted when the switch is open and hence the absence of the key indicates that the switch is open.

What is claimed is:

1. A switch, in particular a battery cutout switch for vehicles including:

a supporting body carrying at least one pair of fixed electrical contacts, a mobile element carrying at least one mobile electrical contact, cooperating with said fixed contacts and movable in a rectilinear direction between an open-contacts position and a closed-contacts position and vice versa, a rotary control member suitable for controlling the movement of the mobile element towards the closed-contacts position, elastic means that tend to push the mobile element towards the open-contacts position, mutually cooperative contact surfaces provided on the rotary control member and on the mobile element for transforming the rotary motion of the rotary control member into linear motion of the mobile element, and mutually cooperative stop mechanisms provided on the supporting body and on the rotary control member for holding the rotary control member in a blocked position corresponding to the closed-contacts position, said stop mechanisms being formed to disengage when the rotary control member is subjected to movement in the axial direction.

2. A switch according to claim 1, wherein said mutually cooperative contact surfaces include at least one inclined surface with a circumferential profile.

3. A switch according to claim 1, wherein said stop mechanisms include a pair of teeth formed on mutually facing heads of the rotary control member and a main body.

4. A switch according to claim 1, including at least one auxiliary mobile contact carried on a sliding shaft cooperating with an end portion of said mobile element.

5. A switch according to claim 1, wherein said rotary control member cooperates with a control knob that can rotate and move linearly.

6. A switch according to claim 5, wherein the rotary control member is connected to a pair of appendages that engage with respective circular-shaped grooves formed on a facing surface of said control knob, said appendages indicating the operational state (ON or OFF) of the switch.

7. A switch according to claim 6, including elastic means of return positioned between the control knob and the main body, which applies torque to the control knob that tends to make it rotate in the opposite direction to that in which the knob is turned for closing the switch.

8. A switch according to claim 1, wherein said rotary control member is associated with a removable control key.

9. A switch according to claim 8, wherein said key includes at least one of said stop mechanisms for holding the rotary control member in the said blocked position.

* * * * *